United States Patent [19]

Parker et al.

[11] 4,283,053

[45] Aug. 11, 1981

[54] AIR POWERED ROCKET SLED GAME

[76] Inventors: Herman Parker, 404 W. Taylor, McAlester, Okla. 74501; Leon Walker, P.O. Box 415, Welch, Okla. 74369; Howard S. Berry, Rte. 1, Blue Jacket, Okla. 74333

[21] Appl. No.: 143,356

[22] Filed: Apr. 24, 1980

Related U.S. Application Data

[63] Continuation-in-part of Ser. No. 871,172, Jan. 23, 1978, Pat. No. 4,209,935.

[30] Foreign Application Priority Data

May 13, 1977 [MX] Mexico ..... 169159

[51] Int. Cl.[3] ..... A63F 9/14

[52] U.S. Cl. ..... 273/86 D; 46/44

[58] Field of Search ..... 273/86 R, 86 D; 46/44, 46/1 K, 41

[56] References Cited

U.S. PATENT DOCUMENTS

| | | | |
|---|---|---|---|
| 3,224,771 | 12/1965 | Altieri | 46/206 X |
| 3,367,658 | 2/1968 | Bayha | 273/86 D |
| 3,611,622 | 10/1971 | Lemelson | 46/44 |
| 3,697,071 | 10/1972 | Anderson | 46/44 X |
| 3,987,581 | 10/1976 | Brown | 46/44 |
| 4,209,935 | 7/1980 | Parker | 46/44 |

*Primary Examiner*—Gene Mancone
*Assistant Examiner*—Mickey Yu
*Attorney, Agent, or Firm*—James H. Chafin

[57] ABSTRACT

An air powered rocket sled game which includes a body member having at least one and preferably two separate elongated air passageways, the ends of each passageway terminating in close proximity to form a substantial loop pattern. A pair of continuous loop intersecting tracks are provided, one along the upper surface of each passageway. The tracks are grooved and are in communication with the interior of the passageways by a plurality of inclined bores for slidably moving rocket sled projectiles along each track in a single direction. The body member includes a centrifugal blower having separate isolated outlets for each passageway and a valve for each passageway to selectively provide a flow of air along the passageway in a direction opposite to the direction of travel of the projectiles. Also included is a method of manufacturing the inclined bores to provide communication between the grooved tracks and the interior air passageways.

8 Claims, 10 Drawing Figures

AIR POWERED ROCKET SLED GAME

CROSS REFERENCE

This is a continuation-in-part application of U.S. application Ser. No. 871,172, filed Jan. 23, 1978 for an "Apparatus For A Rocket Sled Game", subsequently issued July 1, 1980 as U.S. Pat. No. 4,209,935.

BACKGROUND OF THE INVENTION

1. Field of the Invention

The present invention relates to a game of skill which may be used for individual entertainment or by opponents competitively and particularly but not by way of limitation, to an air powered device for propelling light projectiles around looped tracks, the speed of the projectiles being controllable and including a method of manufacture.

2. History of the Prior Art

As was set out in Applicant's parent application, a great number of toys and racing games have been devised which pit the dexterity or skill of the players in opposition as they attempt to maneuver miniature vehicles such as race cars along a fixed track. These cars are normally individually controlled by the players by electrical transformers energizing the track to provide power for the vehicle electric motors. The popularity of such devices has been immense as evidenced by the myriad of types and numbers marketed.

However, due to the nature of the electrical power supply and the abuse received at the hands of children, the aforementioned electrical devices rarely work for prolonged periods of time and upon deterioration often present an electrical safety hazard which has resulted in such games not being recommended for children below eight or ten years of age.

On the other hand, several devices have been patented which utilize air as the propelling force for various different designs of vehicles. However, due to the limited operative success of such devices, they are little more than novel toys. One of the primary problems with the prior art devices is the lack of uniformity of air flow throughout the entire passageway which causes erratic movements of the projectile at different locations on the track.

Another problem with the use of multiple tracks is that of using a single air source, which is fed to the tracks by a manifold system. In these designs, the manipulation of air flow in one track is transferred back through the manifold in the form of pressure fluctuations and affects the action of the projectile on another track thereby rendering the device less than adequate as a competitive, skilled game.

SUMMARY OF THE INVENTION

It is, therefore, an object of the present invention to provide a competitive racing rocket sled game which is simple enough to operate for small children and yet employs a degree of competitive skill to make the game interesting enough for adults. The game is economical to manufacture, extremely durable and safe for children of all ages.

The preferred embodiment of the rocket sled game disclosed herein comprises a body member which is adaptable to set on a table top or on the floor and is designed for the competitive racing of a pair of projectiles or sleds around two adjacent closed-loop tracks of equal length.

The body member or base can be manufactured from two sheets of plastic that is susceptible to vacuum forming. The bottom sheet is provided with a pair of rather deep elongated U-shaped grooves to form passageways.

Each passageway is arranged in a curved, looped fashion so that the ends of each passageway terminate in a near proximity to each other and in alignment to form a substantially closed loop for each passageway. The tracks are designed to intersect in two places and hence, present an ideal place for the passageway ends to terminate. The passageway ends for one track terminate with the other passageway passing therebetween and vice versa.

The bottom sheet of the body member is also provided with a substantially circular recess, the bottom of which is shaped to receive an electric motor therein. The circular side walls are shaped and sized to receive a centrifugal fan therein so that the side walls of the circular recess form the housing for the multiple fan blades of the centrifugal fan.

The circular side walls of the fan housing are provided with a pair of oppositely disposed tangential air ducts, the first air duct being in communication with one end of a first passageway, the opposite air duct being in communication with one end of the second passageway.

Each air duct is provided with a recess for slidably receiving a gate valve member therein. The gate valve is provided with an operator that extends outside of the body member so that the gate valve may be continuously operated from outside of said body member.

The top sheet conforms to the shape of the bottom sheet except in areas of the passageways, recesses and air ducts hereinbefore described. The top sheet is further provided with a plurality of inlet air bores positioned directly above the centrifugal fan to provide outside air supply for the fan.

Along the top of each air passageway, the top sheet is provided with a substantially U-shaped groove which forms a continuous loop, the loops intersecting at two different points. The grooves which serve as tracks for the projectiles, and the air passageways beneath each track are in communication with each other through a plurality of spaced bores along each track member.

There are no bores in the intersecting track areas so that the projectile slides across those areas by momentum generated while sliding along the tracks. This prevents the air from one passageway affecting the projectile of another passageway. The bores are inclined from the vertical and the upper ends of each bore are directed toward the intended direction of travel for each projectile sled. However, the air ducts providing air from the centrifugal motor, enters each passageway and flows in an opposite direction to the direction of travel of the sleds. This has been found to provide uniform air flow through the passageways and will result in uniform movement of the sled. Applicant discovered that if the air was introduced in the passageways along the direction of travel of the sleds, there was considerably more air exiting the inclined bores near the upstream end of the passageway than there was at the downstream end of the passageway, hence, causing erratic movement of the projectiles for any given air valve setting. However, by causing the air to flow in the opposite direction from the direction of the projectiles caused uniform air flow through the bores throughout the length of each passageway.

Further, as hereinbefore stated, it was found necessary to have an individual air supply for each passageway which was unaffected by movement of the valve of the opposite passageway.

In the parent application, the separate air supplies were provided by using a separate blower for each passageway and simply using a common motor for operating both blowers remote from the blowers themselves. However, it has been discovered that separate air supplies may be provided by a single blower so long as it is the form of a centrifugal blower having separate tangential air outlets around the periphery of the blower. Hence, it was found that if the blower had enough blades so that there was never open communication between the two separate passageways, the blower provided what, for all practical purposes, turned out to be a separate air source for each passageway. Hence, a single blower may be used to operate more than one passageway so long as there is no communication between said passageways.

The use of one blower to operate several passageways through an outlet manifold was found to be totally unacceptable since movement of a valve affecting any one of the passageways affected air flow in the other passageways, hence, detracting from the competitive feature of the game. Since the top and bottom sheets of the body member conform to each other's shape except in the area of passageways, the strength of the body member is greatly enhanced thereby causing the game to be extremely durable and further, since there is no exposure to electricity except for a plug-in for the motor, the safety of the game is greatly enhanced.

The invention further includes a method of manufacturing the inclined bores in mass production wherein material is used to manufacture the game which is deformable either by heat or by pressure.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENT

Figure 1:
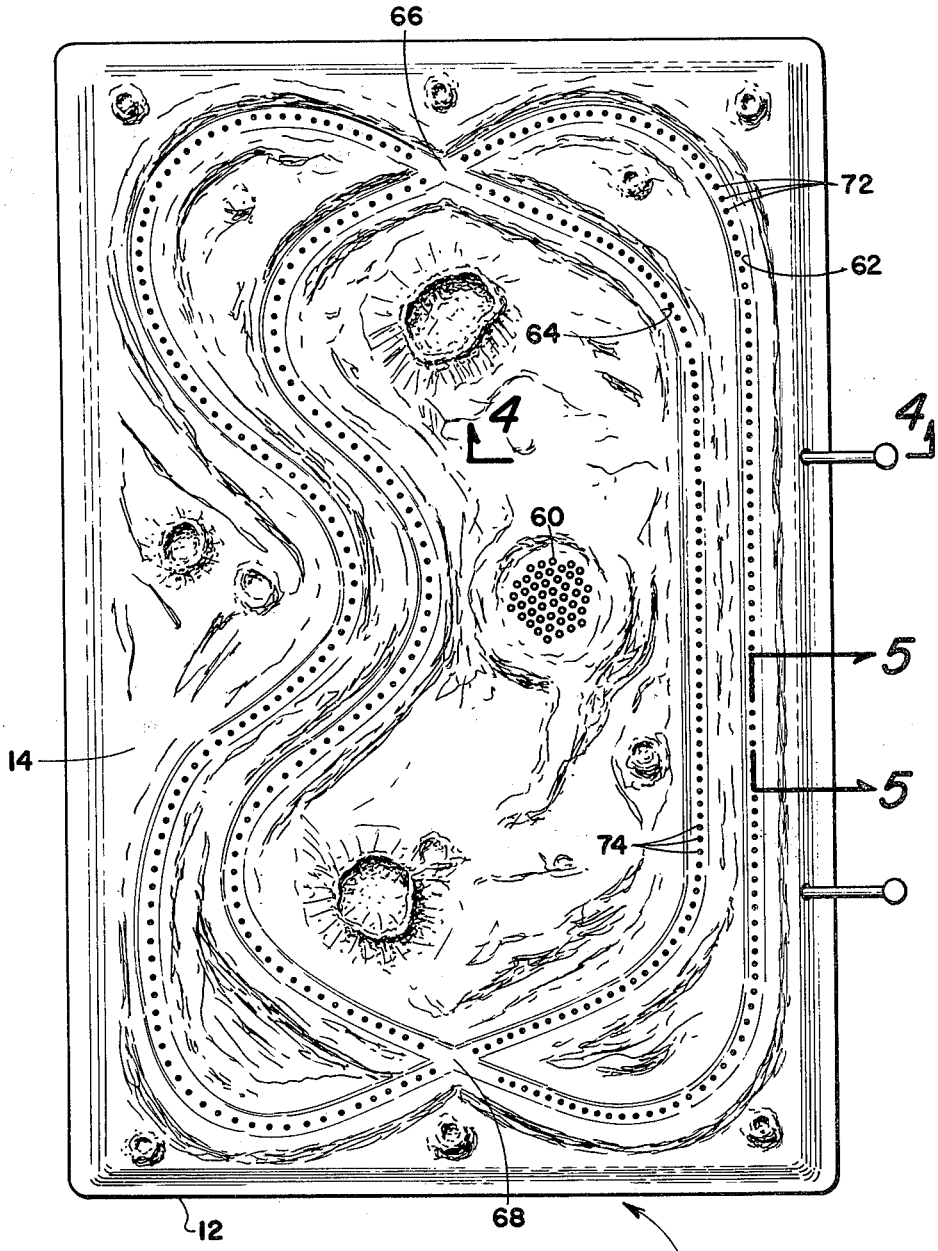
FIG. 1 is a top plan view of a competitive racing game embodying the invention.

Referring to the drawings in detail, reference character 10 generally indicates an air-powered rocket sled game comprising a body member 12 which is typically manufactured from two sheets of a plastic that is susceptible to vacuum forming, the top sheet being designated by reference character 14, the bottom sheet being designated by reference character 16.

The top surface of the bottom sheet is provided with a pair of rather deep, elongated, U-shaped grooves to form passageways 18 and 20, each passageway 18 and 20 is arranged in a curved or looped fashion so that the opposite ends of 22 and 24 of passageway 18 terminate in the near proximity to each other and in alignment to form a substantially closed loop. Likewise, the ends 26 and 28 of passageway 20 terminate in the proximity of each other to form a substantially closed loop for that passageway.

Figure 2:
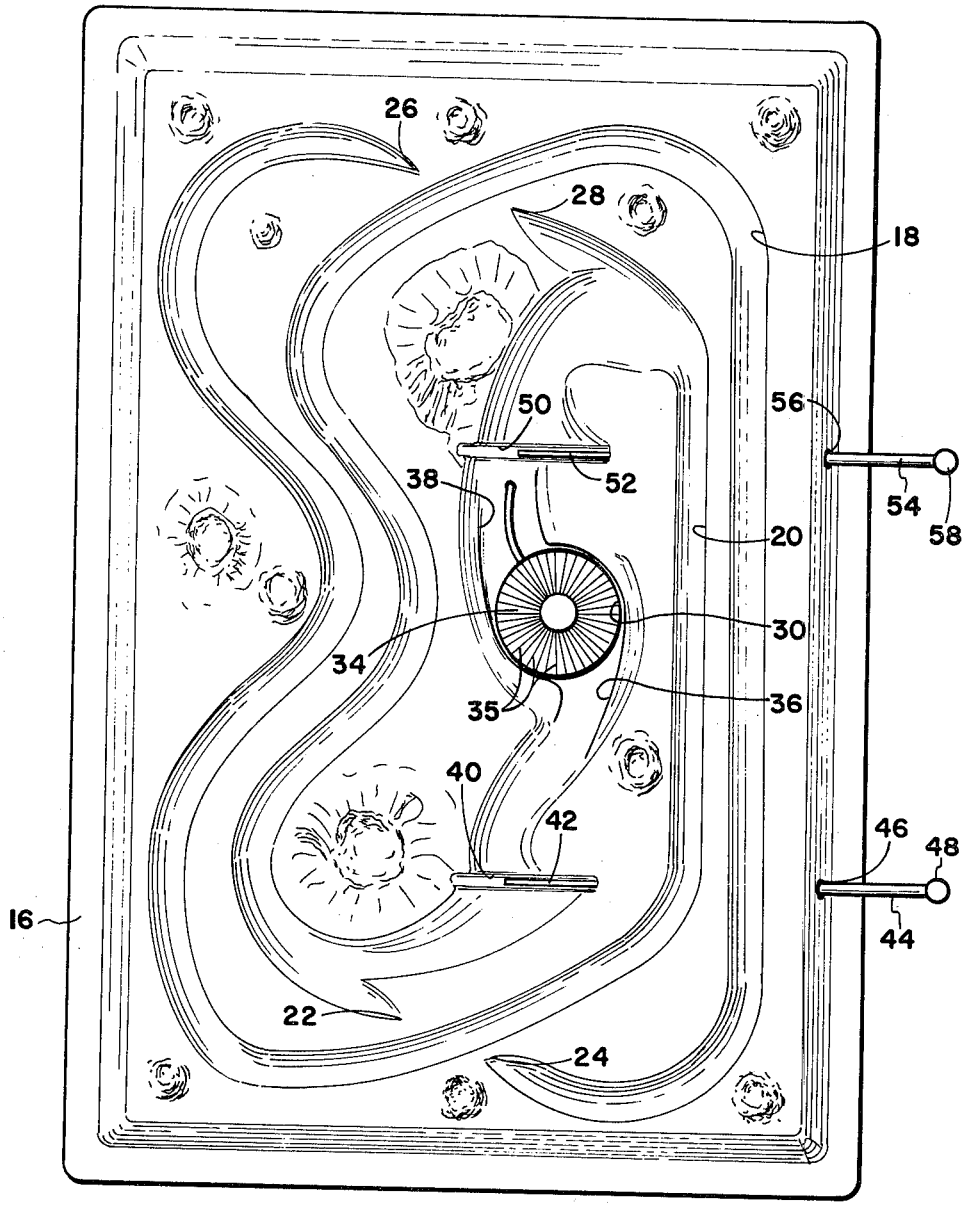
FIG. 2 is a top plan view of the bottom sheet of the device of FIG. 1.
Figure 3:
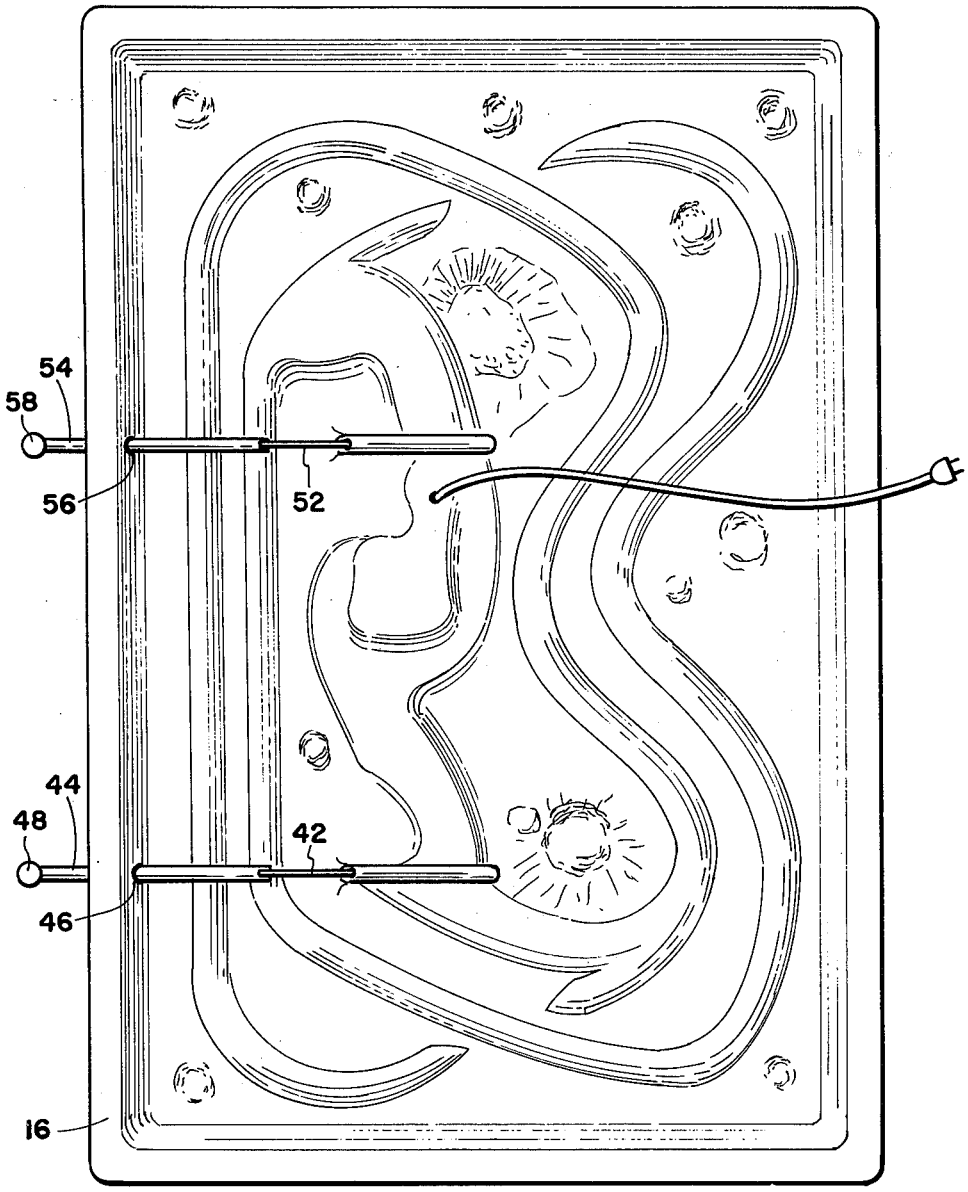
FIG. 3 is a bottom view of the bottom sheet of the device of FIG. 1.
Figure 4:
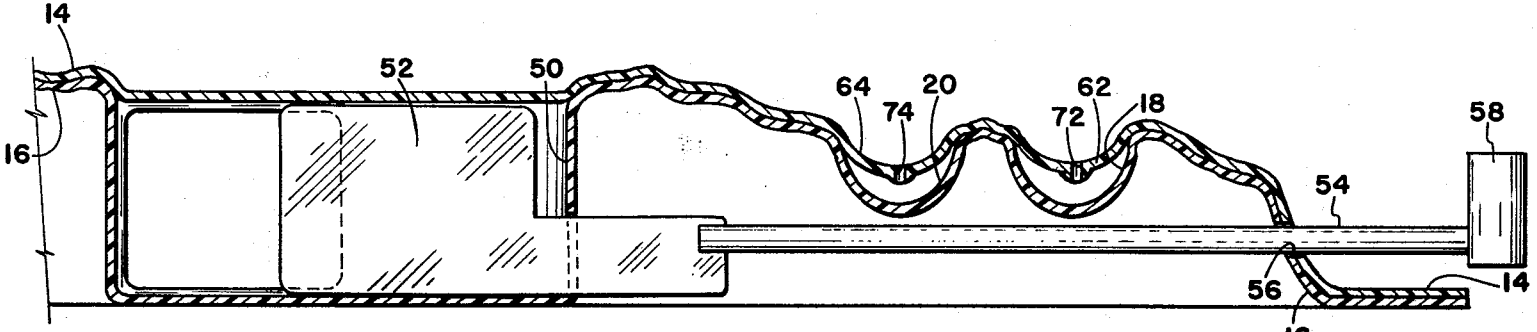
FIG. 4 is an elevational sectional view taken along the broken lines 4—4 of FIG. 1.

It can be seen from FIG. 2 of the drawings that the end portions 22 and 24 may be separated enough to allow the pasageway 20 to pass therebetween. Likewise, the ends 26 and 28 of passageway 20 are separated enough to allow the passageway 18 to pass therethrough thereby making the loops of each passageway of approximately the same length for a purpose that will hereinafter become clear.

The top surface of the bottom sheet 16 is further provided with a circular shaped recess 30 for receiving an electric fan motor 32 therein. Attached to the fan motor 32 is a centrifugal blower 34 having a plurality of radially spaced blades attached thereto. The circular side walls of the recess 30 form the blower housing and are provided with a pair of oppositely disposed tangential air ducts 36 and 38.

The air duct 36 is operably connected to the passageway 18 near the end 22 thereof. A rectangular recess 40 is provided in the air duct 36 for receiving a slidable gate valve closure member 42 therein. The valve closure member 42 is attached to an elongated operator rod 44 which extends exterior of the body member through a bore 46. A handle member 48 may be attached to the outer end of the operator rod 44.

Likewise, the air duct 38 also contains a similar gate valve which comprises an elongated narrow recess 50 for slidably receiving a gate valve closure member 52 therein. An elongated operator rod 54 is secured to the closure member 52 and extends along the bottom of the body member and exterior of the body member through a port 56. The outer end of the operator member 54 is provided with a suitable handle 58.

Hence, it can be seen that the valve operators 44 and 54 may be independently actuated to variably control the air flow through the air ducts 36 and 38, respectively, and into the elongated passageways 18 and 20, respectively. It can further be seen that since the centrifugal blower 34 is provided with a plurality of blower blades 35 that there is no direct common communication between air ducts 36 and 38. Hence, the operation of the valve closure members 42 and 52 are substantially independent and have little or no effect on the air flow and the opposite passageway.

The top plastic sheet member 14 comprises a decorative landscape scene which can be of a lunar type as shown and which serves a purpose of strengthening the plastic sheets as well as adding to the aesthetic value of the game body member.

The top sheet member comprises a substantially circular pattern of holes 60 which serves as an air intake for the centrifugal fan. The blade assembly 35 of the centrifugal fan 34 is open on top and is in communication with the air inlet holes 60 such that only the amount of air needed for ducting to the passageways is taken in and if any resistance caused by the position of the valve closure members 42 and 52 occurs, the air is blown back out or is simply not taken in through the holes 60 rather than create a pressure build up.

The top sheet member 14 further comprises a pair of curved looped substantially U-shaped grooves 62 and 64. The groove 62 is positioned directly above the passageway 18 and provides a continuous track surface. Likewise, the groove 64 is superimposed directly over the passageway 20 to provide a pair of intersections or cross-overs at 66 and 68. The cross-over 66 occurs between the ends 26 and 28 of passageway 20 while the cross-over 68 occurs between the ends 22 and 24 of the passageway 18. The grooves 62 and 64 form tracks for receiving a suitable sled-type projectile 70 therein.

The track 62 is in communication with the passageway 18 by way of a plurality of inclined bores 72. The bores 72 are spaced around the grooves 62 and terminate only at the intersection points 66 and 68 of the track. The incline of the bores 70 are designed so that the upper portions thereof tilt in a direction opposite to the flow of air through the passageway 18. As viewed in FIG. 2, the air in passageway 18 flows from the centrifugal blower 34 through the air duct 36 and into the passageway 18 in a clockwise direction. Since the air is flowing in a clockwise direction in passageway 18, the incline of the bores 72 thereof are tilted in such a way that the upper ends point in a direction which is counter-clockwise along the surface of the track 62.

As hereinbefore stated, it was determined through extensive testing and development that if the inclines were directed with the flow of air, higher pressure occurred near the upstream end of the passageways thereby causing erratic movement of the projectile as it moved along the track surface. However, it was discovered by inclining the bores in the direction opposite to air flow, pressure within the passageways substantially stabilized causing a smooth flow of air for moving the projectiles 70 along the track.

Likewise, the groove 64 comprises a plurality of spaced inclined bores 74 which are likewise inclined in a direction so that the upper ends of the bores are directed opposite to the flow of air through the passageways. It can be seen also that in the passageway 20, air flows in a substantially clockwise direction whereby the incline of the bores 74 are such that the upper ends are directed in a counter-clockwise direction along the track surface 64. Hence, it is seen that a pair of projectiles 70 may be located on the tracks 62 and 64 and both will travel about the tracks in a counter-clockwise direction as viewed in FIG. 1.

Figure 5:
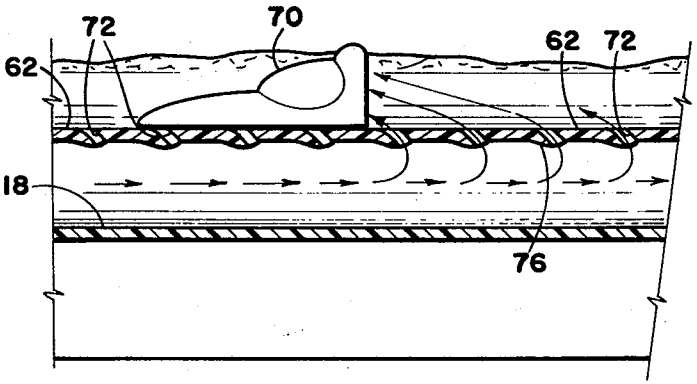
FIG. 5 is an elevational sectional view taken along the broken lines 5—5 of FIG. 1.

Referring to FIG. 5 of the drawings it can be seen that when the plastic material for the upper layer 14 is made of rather thin material and the bores 72 are drilled therein, some heat is generated causing downwardly extending protrusions 76. It is found that these protrusions do not interfere with the operation of the equipment.

Naturally, the body member 10 could be made out of more substantial material and formed by injection molding or any other suitable process.

Figure 6:
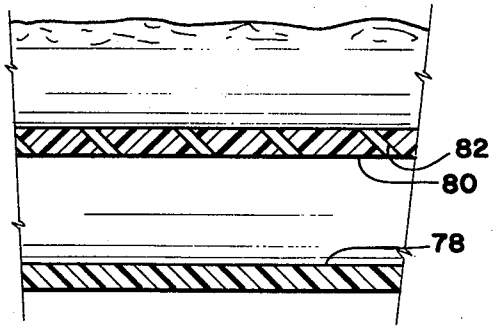
FIG. 6 shows a second embodiment of the section of FIG. 5.

Referring to FIG. 6, it can be seen that a passageway 78 may be created out of more substantial material wherein the material forming the track or upper surface 80 is heavier and subject to cleaner inclined bores 82 which may be drilled therethrough.

Figure 7:
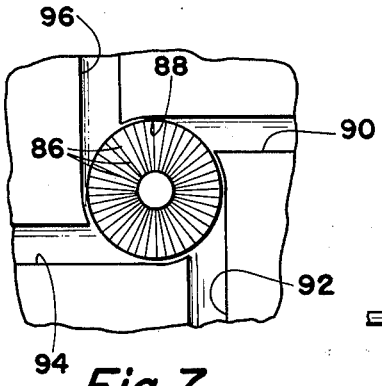
FIG. 7 is a partial plan view of a second embodiment of the game depicting a centrifugal blower feeding four mutually exclusive air ducts.

Referring to FIG. 7 of the drawings, it can be seen that a blower 84 having a substantial number of blades 86 may be set into a substantially circular cavity 88 which has four tangential air ducts 90, 92, 94 and 96 extending outwardly therefrom to operate four different passageways and associated tracks. The number of independent air ducts 90, 92, 94 and 96 are naturally dependent on the size and capacity of the cavity 88 and associated centrifugal blower 84. The important design parameter is that the air ducts 90, 92, 94 and 96 be independent of each other so that there is no plennum chamber or manifold connecting those air ducts which would cause the operation of a valve associated with one air duct to affect the air flow in a separate air duct.

Since the invention hereinbefore described is particularly adaptable either for injection molding or vacuum form molding, one slight problem occurs in the mass production of such units due to the formation of the inclined bores 72 and 74 to allow air communication between the tracks and the internal passageways.

Figure 8:
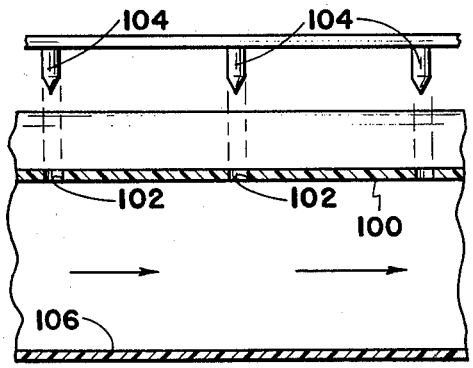
FIG. 8 is an elevational sectional view of a track section whereby the bores are being formed by a punch press.
Figure 9:
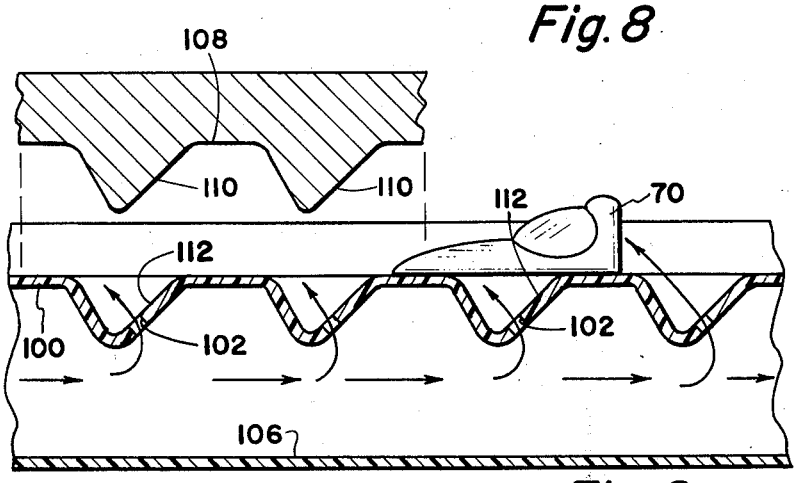
FIG. 9 is a side elevational view of the track of FIG. 8 wherein the bores are being inclined by a suitable heat press.
Figure 10:
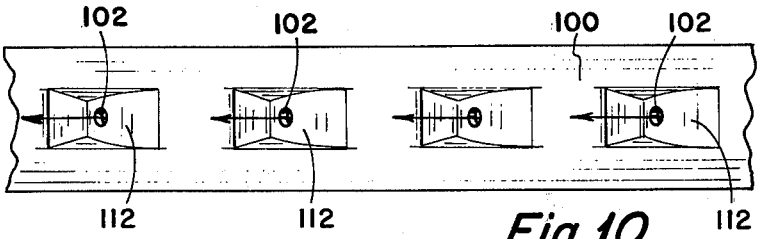
FIG. 10 is a top plan view of the finished track of FIG. 9.

FIGS. 8, 9 and 10 depict a method and apparatus for forming the inclined bores in the individual tracks. Referring to FIG. 8, reference character 100 depicts a section of the groove of a track wherein vertical holes 102 are simultaneously punched by a multiple punch mechanism 104. Although FIG. 8 shows the track in place over the air passageway, this operation would probably be formed over the upper surface of the material 100 before it is installed over the passageways. However, for clarity, the passageways are shown with the bottom of the passageway being designated by reference character 106.

FIG. 9 then depicts a method for inclining the bores 102 which is accomplished by a multiple heat press mechanism 108 having downwardly extending spaced protrusions 110 for forming the proper angle. After the holes have been punched by the multiple punch mechanism 104, the heat press with heated protrusions 110 is then lowered over the track area thereby heating the plastic and causing it to deform in substantially V-shaped deformations at or about each bore 102, these deformations being indicated by reference character 112. The deformations need to occur only about the area of the hole thereby leaving a substantially smooth track surface for the projectile 70 to travel therealong.

FIG. 10 is a top view of the track after the heat press has been applied showing the recesses 112 along the upper surface of the track.

From the foregoing, it is apparent that the present invention provides an air-powered rocket sled game which is relatively easy to construct and therefore, economical to manufacture. It is further seen that the present invention also provides a method of manufacture using mass production techniques to further make the game more economical to produce. For example, the process for forming the inclined bores as depicted in FIGS. 8, 9 and 10 could be utilized on non-heat sensitive material so long as it is deformable. The material 100 containing the track could be of a deformable metal wherein the indentations are formed by a press mechanism which is not heated.

Whereas, the present invention has been described in particular relation to the drawings attached hereto, other and further modifications apart from those shown or suggested herein may be made within the spirit and scope of the invention.

What is claimed is:

1. An apparatus for a rocket sled game comprising a body member;

a pair of elongated substantially enclosed passageways within the body member, the ends of each said passageway being disposed adjacent each other to form a pair of substantial loops of approximately the same length;

a pair of elongated grooved tracks, one provided along the upper outside surface of each passageway to form a pair of continuous loops, each track being in communication with its respective passageway through a plurality of spaced bores along the bottom of each grooved track;

a projectile sled adapted for slidably fitting in the grooved tracks for traveling in a single direction along each said track;

the bores of said plurality of spaced bores being inclined from the vertical, the upper ends of each bore being directed toward the direction of travel of said projectile sled;

means for selectively introducing a separate flow of air into one end of each passageway in a direction opposite the direction of travel of the projectile sled to thereby selectively force the projectile sled along each grooved track in the direction associated with the inclined bores and opposite the direction of flow of air through each passageway, wherein the means for selectively introducing a flow of air comprises a blower compartment, a centrifugal blower mounted in the compartment, the intake thereof being in communication with the air outside the body member; a pair of oppositely disposed air ducts tangentially extending from the blower compartment, one said air duct being in communication with one end of a first passageway and having a first valve member interposed in said air duct between the blower and the first passageway, the second said air duct being in communication with one end of the second passageway and having a second valve member interposed in said air duct between the blower and said second passageway, each said valve member having a valve operator extending exterior of the body member.

2. A rocket sled game as set forth in claim 1 wherein the blower is a centrifugal blower having a plurality of blower blades, the number of blades being sufficient to insure that there is no open communication between the first and second passageways through said blower compartment.

3. A rocket sled game as set forth in claim 2 wherein each air duct is in substantially tangential communication with the passageways to force air longitudinally along each said passageway.

4. A rocket sled game as set forth in claim 1 wherein each valve member is a gate valve, said operator members being elongated rods slidably carried by the body member and the outer ends thereof extending beyond the body member whereby reciprocal motion of said rods actuates a gate valve.

5. An apparatus for a rocket sled game comprising a body member;

at least one elongated substantially enclosed separate passageway within the body member, the ends of said passageway terminating in close proximity to each other and in substantial alignment to form a substantial loop;

an elongated grooved track provided along the upper outside surface of said passageway to form a continuous loop track, the track being in communication with the passageway through a plurality of spaced bores along the bottom of the track;

a projectile sled adapted for slidably fitting in said grooved track for traveling in a single direction along said track;

each bore of said pluarlity of bores being inclined from the vertical, the upper ends of said bores being directed toward the direction of travel of said projectile sled;

means for selectively introducing a flow of air into one end of said passageway in a direction opposite to the direction of travel of the projectile sled, the air exiting said bores thereby providing a force to propel the projectile sled along the grooved track, wherein the means for selectively introducing a flow of air into said passageway comprises a blower compartment, a centrifugal blower mounted in the compartment, the intake of said blower being in communication with the outside air outside of said body member, said blower having a separate and distinct outlet associated with said passageway, an air duct for said passageway extending between one end of said passageway to said separate outlet of the blower, a valve interposed in said air duct, said valve having a valve operator extending exterior of the body member.

6. A rocket sled game as set forth in claim 5 wherein the number of passageways is no more than four.

7. A rocket sled game as set forth in claim 5 wherein there are multiple passageways and tracks, said grooved tracks being provided with intersections, there being no bores in the grooved tracks at said intersections.

8. A rocket sled game as set forth in claim 1 wherein said valve is a gate valve.

* * * * *